US006119616A

United States Patent [19]

Hannasch

[11] Patent Number: 6,119,616

[45] Date of Patent: Sep. 19, 2000

[54] BOAT DOCKING SYSTEM

[76] Inventor: Kevin Hannasch, 2932 - 15th Ave. South, Moorhead, Minn. 56560

[21] Appl. No.: 09/476,433

[22] Filed: Dec. 30, 1999

[51] Int. Cl.[7] ..... B63B 21/00

[52] U.S. Cl. ..... 114/230.1; 114/230.15

[58] Field of Search ..... 114/230.1, 230.15, 114/230.25, 230.26, 230.27, 230.28, 230.29, 230.3

[56] References Cited

U.S. PATENT DOCUMENTS

| | | | |
|---|---|---|---|
| 3,373,714 | 3/1968 | Hart | 114/230.15 |
| 3,636,908 | 1/1972 | Feldman et al. | 114/230.15 |
| 4,284,026 | 8/1981 | Martinson | 114/230.15 |

*Primary Examiner*—Jesus D. Sotelo
*Attorney, Agent, or Firm*—Michael S. Neustel

[57] ABSTRACT

A boat docking system for allowing an individual to dock a boat without the assistance of another individual. The inventive device includes a receiver member attachable to a dock, a support bracket adjustably positioned within the receiver member, an extended member adjustably extending from the support bracket, a pair of support members attached to the distal end of the extended member forming a V-shape, and a pair of cushions surrounding each of the support members. The pair of cushions are preferably rotatably positioned about the support members for allowing the boat to move upwardly and downwardly with the wave movements without interference. A pair of securing brackets and cables are preferably attached to the extended member for providing horizontal stability during operation. A center protective member is preferably attached to the end of the extended member between the pair of support members for protecting the hull of a boat. The support bracket is an L-shaped member having a plurality of apertures that receive a fastener extending through the receiver member. The extended member is slidably positioned within the support bracket with a corresponding plurality of apertures that receive a fastener for adjustment of the length.

15 Claims, 5 Drawing Sheets

BOAT DOCKING SYSTEM

BACKGROUND OF THE INVENTION

1. Field of the Invention

The present invention relates generally to boat docking devices and more specifically it relates to a boat docking system for allowing an individual to dock a boat without the assistance of another individual.

Individuals that operate boats such as yachts often times find it extremely difficult to dock their boats without the assistance of an individual upon the dock. Sometimes when an individual attempts to dock their boat themselves they end up engaging the dock with their boat. This damages both the dock and the boat if not done properly. Hence, there is a need for a device that allows individuals to dock their boats by themselves without damaging the dock or boat.

2. Description of the Prior Art

Docks have been in use for years. Typically, a dock is an elongated structure that extends into the water at depths sufficient to receive a boat. The dock includes a plurality of hooks for tying rope upon for retaining the boat adjacent the dock. Some docks include a protective layer such as tires or rubber for reducing damage to the dock and the boat.

The main problem with conventional docks is that they are not suitable for allowing an individual to dock their boat without the assistance of another individual. When an individual attempts to dock the boat themselves they sometimes damage the dock and the boat.

Examples of docking systems include U.S. Pat. No. 4,284,026 to Martinson et al.; U.S. Pat. No. 4,568,295 to Poldervaart; U.S. Pat. No. 4,534,740 to Poldervaart; U.S. Pat. No. 5,174,234 to Ryan; U.S. Pat. No. 3,636,908 to Feldman et al.; U.S. Pat. No. 3,373,714 to Hart; U.S. Pat. No. 3,570,256 to Thompson; U.S. Pat. No. 5,441,007 to Hunt which are all illustrative of such prior art.

While these devices may be suitable for the particular purpose to which they address, they are not as suitable for allowing an individual to dock a boat without the assistance of another individual. Conventional docks do not allow an individual to dock their own boat without the assistance of another party.

In these respects, the boat docking system according to the present invention substantially departs from the conventional concepts and designs of the prior art, and in so doing provides an apparatus primarily developed for the purpose of allowing an individual to dock a boat without the assistance of another individual.

SUMMARY OF THE INVENTION

In view of the foregoing disadvantages inherent in the known types of docks now present in the prior art, the present invention provides a new boat docking system construction wherein the same can be utilized for allowing an individual to dock a boat without the assistance of another individual.

The general purpose of the present invention, which will be described subsequently in greater detail, is to provide a new boat docking system that has many of the advantages of the docks mentioned heretofore and many novel features that result in a new boat docking system which is not anticipated, rendered obvious, suggested, or even implied by any of the prior art docks, either alone or in any combination thereof.

To attain this, the present invention generally comprises a receiver member attachable to a dock, a support bracket adjustably positioned within the receiver member, an extended member adjustably extending from the support bracket, a pair of support members attached to the distal end of the extended member forming a V-shape, and a pair of cushions surrounding each of the support members. The pair of cushions are preferably rotatably positioned about the support members for allowing the boat to move upwardly and downwardly with the wave movements without interference. A pair of securing brackets and cables are preferably attached to the extended member for providing horizontal stability during operation. A center protective member is preferably attached to the end of the extended member between the pair of support members for protecting the hull of a boat. The support bracket is an L-shaped member having a plurality of apertures that receive a fastener extending through the receiver member. The extended member is slidably positioned within the support bracket with a corresponding plurality of apertures that receive a fastener for adjustment of the length.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a boat docking system that will overcome the shortcomings of the prior art devices.

A second object is to provide a boat docking system for allowing an individual to dock a boat without the assistance of another individual.

Another object is to provide a boat docking system that reduces damage to the dock and the boat.

An additional object is to provide a boat docking system that reduces accidents incurred due to an individual attempting to dock a boat themselves.

A further object is to provide a boat docking system that allows an individual to easily dock their boat even during windy and wavy conditions.

Another object is to provide a boat docking system that is adjustable for accommodating various sizes of boats.

An additional object is to provide a boat docking system that is adjustable both horizontal and vertically.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
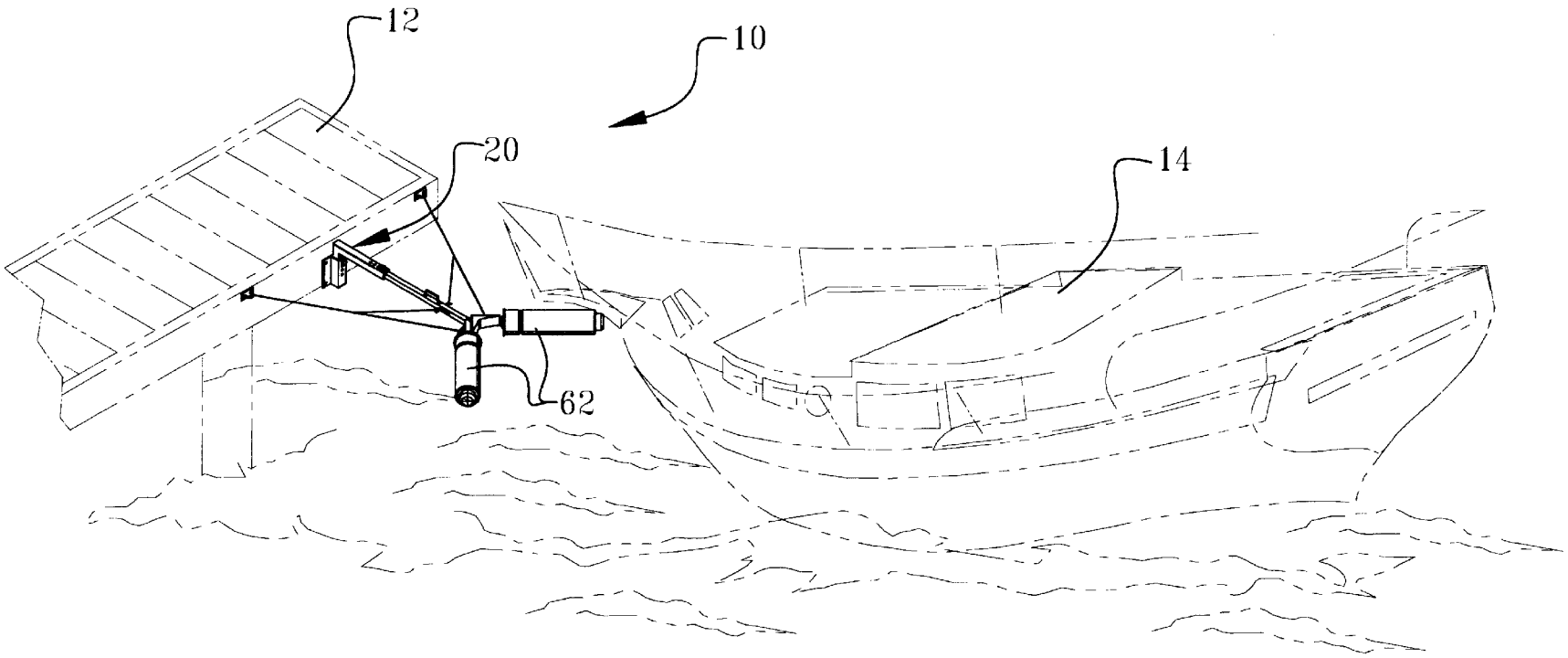
FIG. 1 is an upper perspective view of the present invention attached to a dock.

Turning now descriptively to the drawings, in which similar reference characters denote similar elements throughout the several views, FIGS. 1 through 5 illustrate a boat docking system 10, which comprises a receiver member 20 attachable to a dock 12, a support bracket 30 adjustably positioned within the receiver member 20, an extended member 40 adjustably extending from the support bracket 30, a pair of support members 60 attached to the distal end of the extended member 40 forming a V-shape, and a pair of cushions 62 surrounding each of the support members 60. The pair of cushions 62 are preferably rotatably positioned about the support members 60 for allowing the boat 14 to move upwardly and downwardly with the wave movements without interference. A pair of securing brackets 52 and cables 50 are preferably attached to the extended member 40 for providing horizontal stability during operation. A center protective member 70 is preferably attached to the end of the extended member 40 between the pair of support members 60 for protecting the hull of a boat 14. The support bracket 30 is an L-shaped member having a plurality of apertures 24 that receive a fastener 25 extending through the receiver member 20. The extended member 40 is slidably positioned within the support bracket 30 with a corresponding plurality of apertures 24 that receive a fastener 25 for adjustment of the length.

Figure 2:
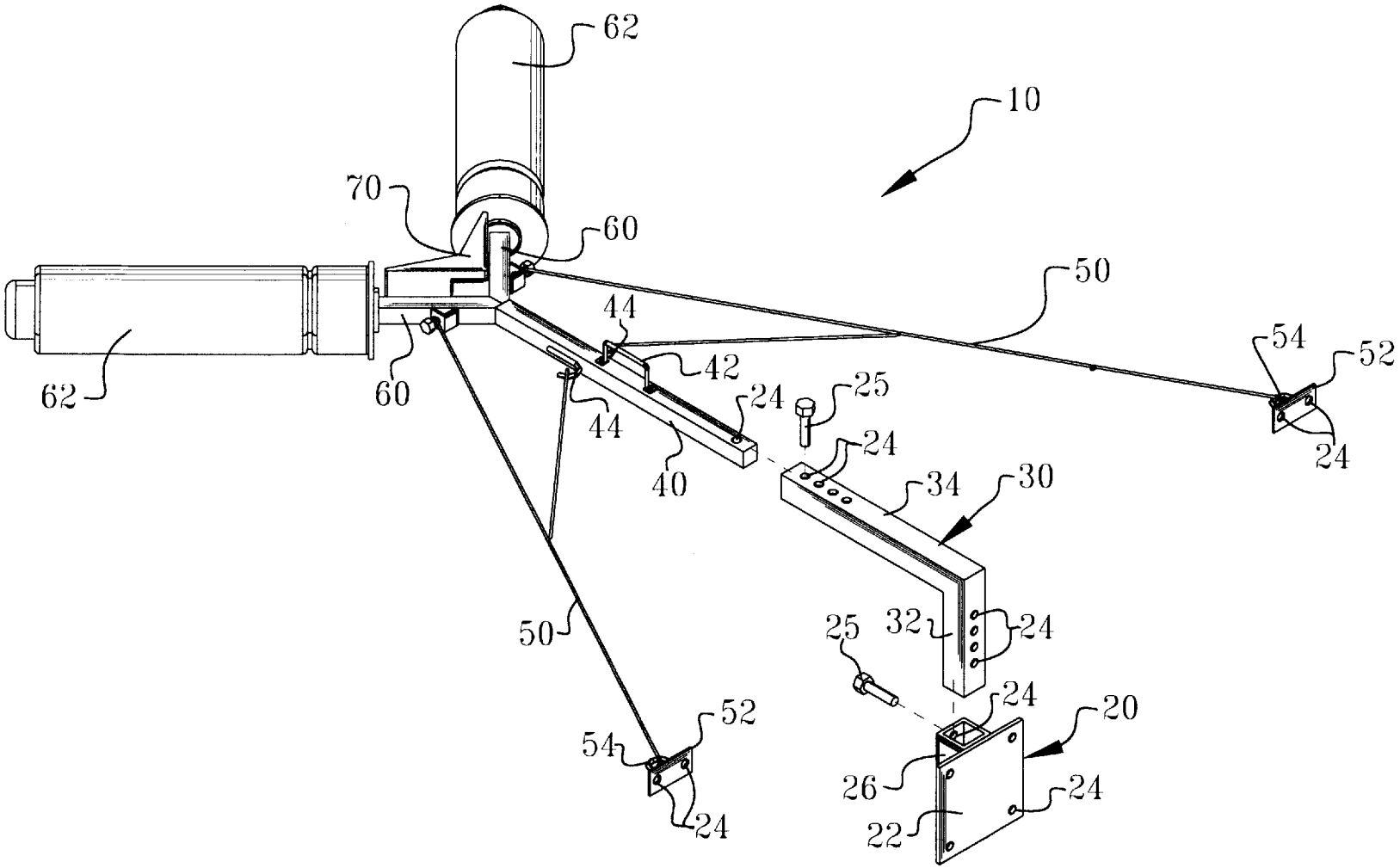
FIG. 2 is an exploded rear upper perspective view of the present invention.
Figure 4:
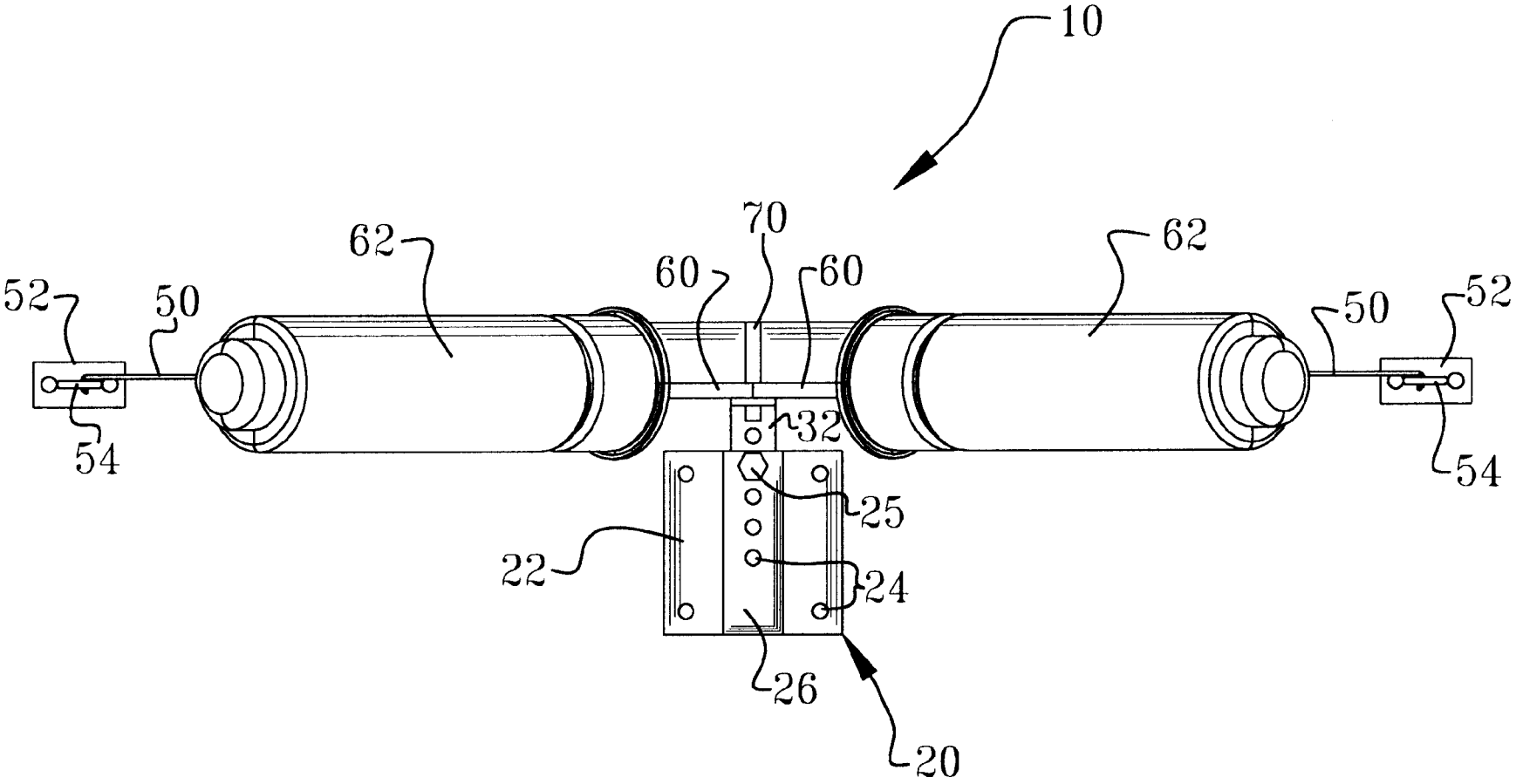
FIG. 4 is a front view of the present invention.

As best shown in FIG. 2 of the drawings, the receiver member 20 is comprised of a base 22 and a receiver tube 26 attached to the base 22. The base 22 preferably includes a plurality of apertures 24 for receiving a plurality of fasteners 25 for retaining the receiver member 20 to the dock 12. The receiver tube 26 also preferably includes a plurality of apertures 24 for allowing adjustment of the vertical position of the support bracket 30 as best shown in FIG. 4 of the drawings. It can be appreciated by one skilled in the art that the base 22 may be comprised of various shapes and sizes.

Figure 5:
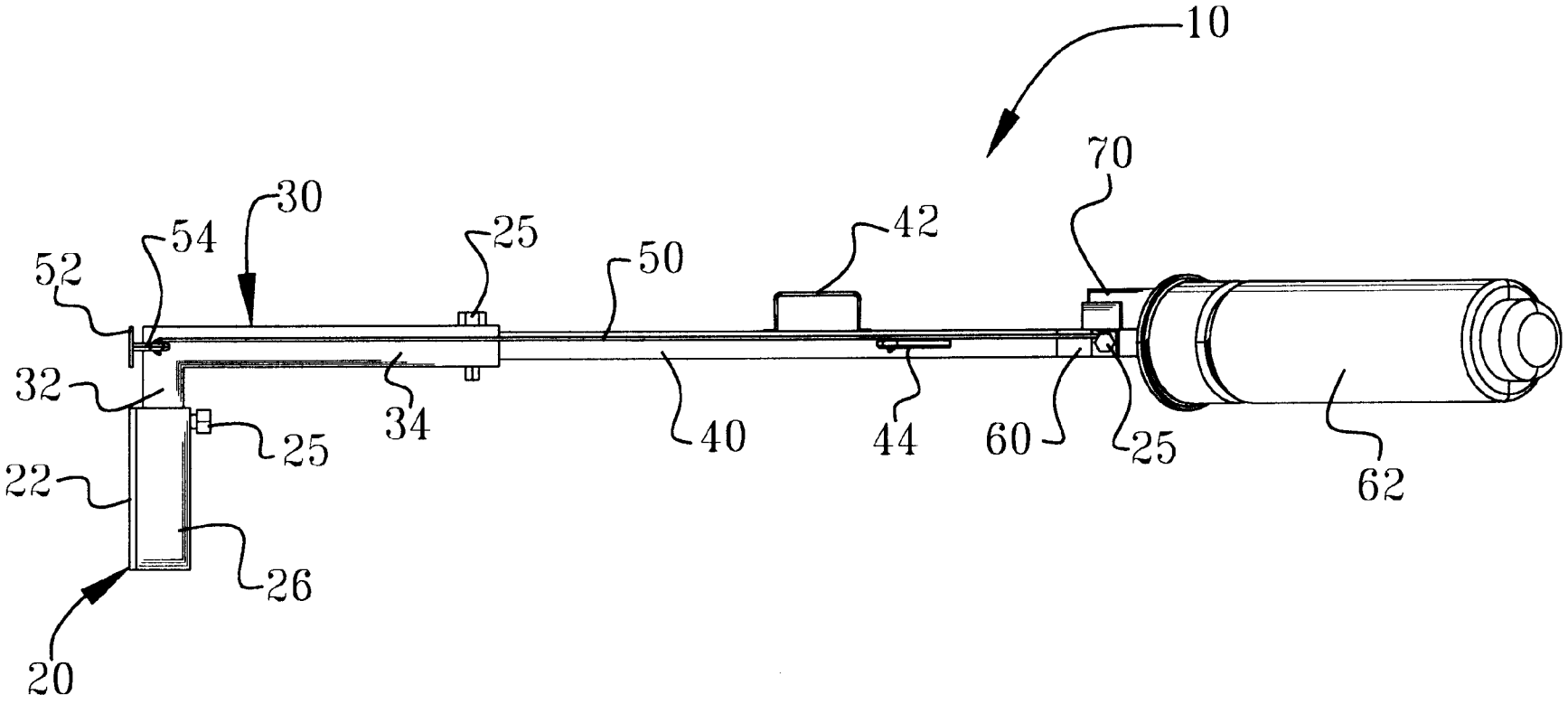
FIG. 5 is a side view of the present invention.

As best shown in FIG. 2 of the drawings, the support bracket 30 is preferably L-shaped that is formed to be received by the receiver tube 26 of the receiver member 20. The support bracket 30 has a lower member 32 and an upper member 34 wherein the lower member 32 is slidably received by the receiver tube 26 as best shown in FIG. 5 of the drawings. The lower member 32 includes a plurality of apertures 24 as best shown in FIG. 2 of the drawings for receiving a fastener 25 inserted through the receiver tube 26 for adjusting the vertical position of the support bracket 30.

As best shown in FIGS. 2 and 5 of the drawings, an extended member 40 is slidably received by the upper member 34 of the support bracket 30. Both the extended member 40 and the upper member 34 preferably have a plurality of apertures 24 for allowing horizontal alignment of the extended member 40. It can be appreciated that the extended member 40 may be permanently attached to the support bracket 30. It can also be appreciated that the extended member 40 may be straight or angled with respect to the support bracket 30.

As shown in FIGS. 1 through 5 of the drawings, a pair of securing brackets 52 are provided that receive a pair of corresponding cables 50. The securing brackets 52 have a pair of loops 54 that receive the length of cable. A pair of hooks 44 upon opposing sides of the extended member 40 receive the distal ends of the cables 50 thereby providing horizontal support to the extended member 40 while receiving a boat 14 within the present invention. The extended member 40 preferably includes a handle 42 for allowing easy grasping by the user.

Figure 3:
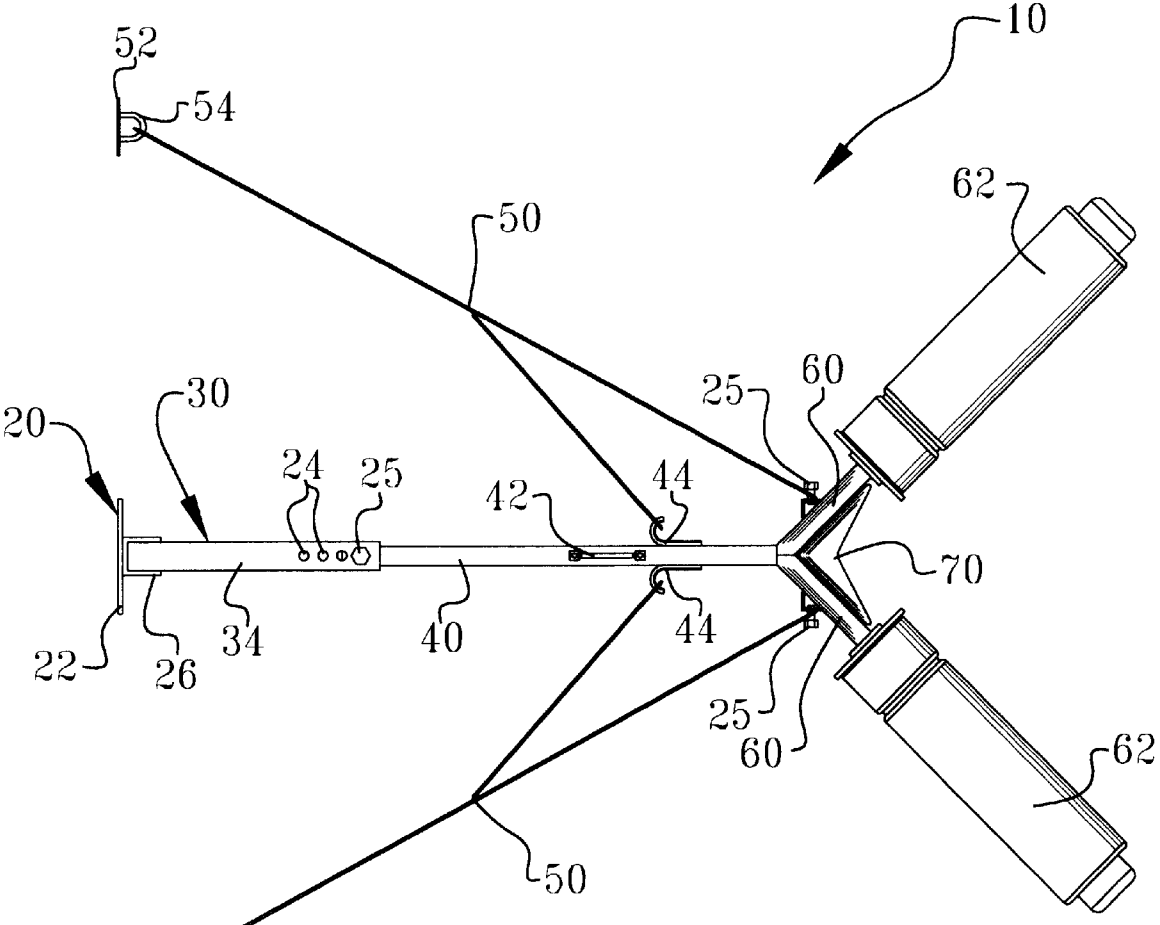
FIG. 3 is a top view of the present invention.

As shown in FIGS. 1 through 4 of the drawings, a pair of support members 60 extend from the distal end of the extended member 40 forming a V-shape for receiving the front portion of a boat 14. As best shown in FIG. 3 of the drawings, a pair of cushions 62 are preferably positioned upon the support members 60. The cushions 62 are preferably rotatably positioned about the support members 60 to allow a boat 14 to move upwardly and downwardly with the wave movements. A center protective member 70 is preferably attached between the pair of support members 60 as best shown in FIG. 3 of the drawings.

In use, the user adjusts the support bracket 30 and the extended member 40 to the desired vertical and horizontal position depending upon the size of the boat 14. The user operating the boat 14 positions the front of the boat 14 into the V-portion created by the pair of support members 60 while leaving the motor idle thereby applying a forward force from the boat 14 to the cushions 62 ad the support members 60. The user then exits the boat 14 and ties the boat 14 to the adjacent dock 12 without requiring the assistance of another individual.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A boat docking system comprising a receiver member attachable to a dock;

a support bracket attached to said receiver member for extending away from a dock;

a means for receiving a boat attached to said support bracket;

wherein said means for receiving a boat comprises a pair of support members attached to a distal end of said support bracket; and a pair of cushions attached about said pair of support members.

2. The boat docking system of claim 1, wherein said pair of cushions are rotatably attached about said pair of support members.

3. The boat docking system of claim 1, including a protective member attached between said pair of support members.

4. The boat docking system of claim 1, wherein said pair of support members form a V-shape.

5. The boat docking system of claim 4, wherein said pair of cushions are rotatably attached about said pair of support members.

6. A boat docking system, comprising:

a receiver member attachable to a dock;

a support bracket attached to said receiver member extending away from a dock, wherein said support bracket is vertically adjustable within said receiver member;

an extended member adjustably positioned to said support bracket opposite of said receiver member, wherein said extended member is horizontally adjustable; and a pair of support members attached to a distal end of said extended member for receiving a front portion of a boat.

7. The boat docking system of claim 6, including a pair of cushions attached about said pair of support members.

8. The boat docking system of claim 7, wherein said pair of cushions are rotatably attached about said pair of support members.

9. The boat docking system of claim 6, including a protective member attached between said pair of support members.

10. The boat docking system of claim 9, wherein said pair of support members form a V-shape.

11. The boat docking system of claim 6, wherein said pair of support members form a V-shape for receiving a front portion of a boat.

12. The boat docking system of claim 11, including a pair of cushions attached about said pair of support members.

13. The boat docking system of claim 12, wherein said pair of cushions are rotatably attached about said pair of support members.

14. A boat docking system, comprising:

a receiver member attachable to a dock;

a support bracket attached to said receiver member extending away from a dock, wherein said support bracket is vertically adjustable within said receiver member;

an extended member adjustably positioned to said support bracket opposite of said receiver member, wherein said extended member is horizontally adjustable;

a pair of cables attached to said extended member upon opposing sides of said extended member, wherein the distal ends of said pair of cables are attached to a dock; and a pair of support members attached to a distal end of said extended member for receiving a front portion of a boat.

15. The boat docking system of claim 14, including a pair of cushions rotatably attached about said pair of support members.

* * * * *